United States Patent [19]

Nakagawa et al.

[11] Patent Number: 4,691,911

[45] Date of Patent: Sep. 8, 1987

[54] PAPER FEEDING APPARATUS FOR PRINTERS

[75] Inventors: Hitoshi Nakagawa; Kohei Kitahara, both of Nagano, Japan

[73] Assignee: Seiko Epson Kabushiki Kaisha, Tokyo, Japan

[21] Appl. No.: 890,574

[22] Filed: Jul. 30, 1986

[30] Foreign Application Priority Data

Jul. 31, 1985 [JP] Japan ..... 60-169440

[51] Int. Cl.[4] ..... B65H 3/44

[52] U.S. Cl. ..... 271/9; 271/109; 271/171; 400/605; 400/629; 400/636.2; 400/639

[58] Field of Search ..... 271/9, 109, 171; 400/624, 625, 629, 605, 636.2, 639

[56] References Cited

U.S. PATENT DOCUMENTS 4,475,731 10/1984 Wood ..... 271/9

4,570,919 2/1986 Huang ..... 271/9

*Primary Examiner*—Richard A. Schacher

*Attorney, Agent, or Firm*—Blum, Kaplan

[57] ABSTRACT

A paper feeding apparatus for a printer. There are at least two mounting members, each of which is adapted to contain sheets of paper. A paper feeding assembly is associated with each of the mounting members and contacts the paper in the mounting member for feeding single sheets of paper. A paper feed gear is operatively coupled to each of the paper feeding assemblies for co-rotation therewith. A sun gear is present proximate each of the paper feeding gears and each is rotatable about a center point. A transmission mechanism transmits rotational power in first and second directions from a paper feed motor in the printer to each of the sun gears. The first and second directions are opposite to one another. A selector member is associated with each of the paper feed assemblies and has a planet gear on a first arm and a protrusion on a second arm. The selector member is rotatable about the center point of the corresponding sun gear. The planet gear engages with the corresponding sun gear. A selective camming assembly is associated with each of the paper feeding assemblies for controlling the rotation of the corresponding selector member by interaction with the protrusion on the corresponding selector member. This causes the selective engagement of the corresponding planet gear and paper feed gear so that rotational power from the paper feed motor is transmitted to the paper feeding assembly when the paper feed motor rotates in the proper combination of the first and second directions. As a result, a single sheet of paper is fed to the printer from a selected mounting member which is determined by the sequence of rotations of the paper feed motor in the first and second directions.

24 Claims, 13 Drawing Figures

PAPER FEEDING APPARATUS FOR PRINTERS

BACKGROUND OF THE INVENTION

The invention is generally directed to a paper feeding apparatus for use in a printer and in particular to a cut sheet feeder which can select an appropriate cut sheet from various types of mounted cut sheets, and feed the appropriate sheet into the printer.

Paper feeding apparatuses are well known in the art and cut sheet feeders are applicable for use with various printers used as typewriters or as word processors. The cut sheet feeders remove the need for an individual to separately align each sheet of paper in the printer or typewriter. Instead, a cartridge tray or other type of paper holding device can be filled with many sheets which are fed singly to the printer at appropriate times. In particular, a single cut sheet feeder has compartments for different sizes of paper further speeding the paper feeding process.

Conventional cut sheet feeders are driven in two different ways. The first type of cut sheet feeder incorporates an electrical selecting element such as a motor or a solenoid. The feeder is directly electrically connected to a printer so that the printer has direct control over the motor or solenoid. The second type of conventional cut sheet feeder provides power to the cut sheet feeder by use of a paper feeding mechanism usually coupled to the printer's platen. The cut sheet feeder is driven by a combination of clockwise and counterclockwise rotation of the paper feeding motor. In both cases, a one-way clutch or a ratchet device is used to prevent the paper feeding assembly from drawing back the sheet already wound into the paper feeding mechanism of the printer.

One-way clutches and ratchets are expensive mechanical elements and result in an increase in the cost of a cut sheet feeder utilizing these elements. The requirement that a cut sheet feeder be powered electrically by the printer increases the complexity of the cut sheet feeder unit and limits its application to printers specifically adapted to control such a cut sheet feeder.

Accordingly, there is a need for a cut sheet feeder which enables selection and feeding of single sheets from a variety of compartments or trays in the cut sheet feeder, powered by a mechanical linkage with the paper feeding mechanism of the printer, and without the need for expensive components such as a one-way clutch or a ratchet.

SUMMARY OF THE INVENTION

The invention is generally directed to a paper feeding apparatus for a printer. There are at least two mounting units each of which is adapted to hold a plurality of sheets of paper. A paper feeding roller is associated with each of the mounting units and contacts the paper in the mounting unit for feeding a single sheet of paper. A paper feed gear is operatively coupled to the paper feed roller for co-rotation with the paper feed roller. A sun gear is proximate each of the paper feed gears. A transmission mechanism transmits rotational power in first and second directions, the second direction being opposite to the first direction, from a paper feed motor in the printer to each of the sun gears. Each of a series of selector levers, one of which is associated with each of the paper feed rollers, has a planet gear at one end and a protrusion at the other end. The selector lever is rotatable about a fulcrum point which is also the center of rotation of the corresponding sun gear. Each planet gear engages with the corresponding sun gear. A selective camming member is associated with each of the paper feed mechanisms. The selective camming member in operative association with the protrusion controls the rotation of the corresponding selector lever to cause the selective engagement of the corresponding planet and sun gears when the paper feed motor rotates in a proper combination of the first and second directions. As a result, a single sheet of paper is fed to the printer from a selected mounting member determined by the sequence of rotation in the first and second directions by the paper feed motor.

Accordingly, it is an object of the invention to provide an improved paper feeding apparatus for feeding single sheets of paper.

Another object of the invention is to provide an improved cut sheet feeder which can select a cut sheet of paper out of a variety of types of paper as necessary and feed the paper to the printer.

A further object of the invention is to provide a cut sheet feeder which is mechanically powered by the printer.

Still another object of the invention is to provide a cut sheet feeder which is mechanically powered by the printer and obviates the need for expensive one-way clutches and ratchet mechanisms.

Yet another object of the invention is to provide a cut sheet feeder mechanically powered by the printer paper feed mechanism which can select appropriate sheets of paper from various compartments based on software control by the printer.

Yet a further object of the invention is to provide an improved cut sheet feeder in which power is provided through the paper feeding mechanism of the printer and sheets from various sheet mounting devices can be selected by use of selector devices composed of planet gears, cams and levers in mesh with cams.

Still other objects and advantages of the invention will in part be obvious and will in part be apparent from the specification.

The invention accordingly comprise the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
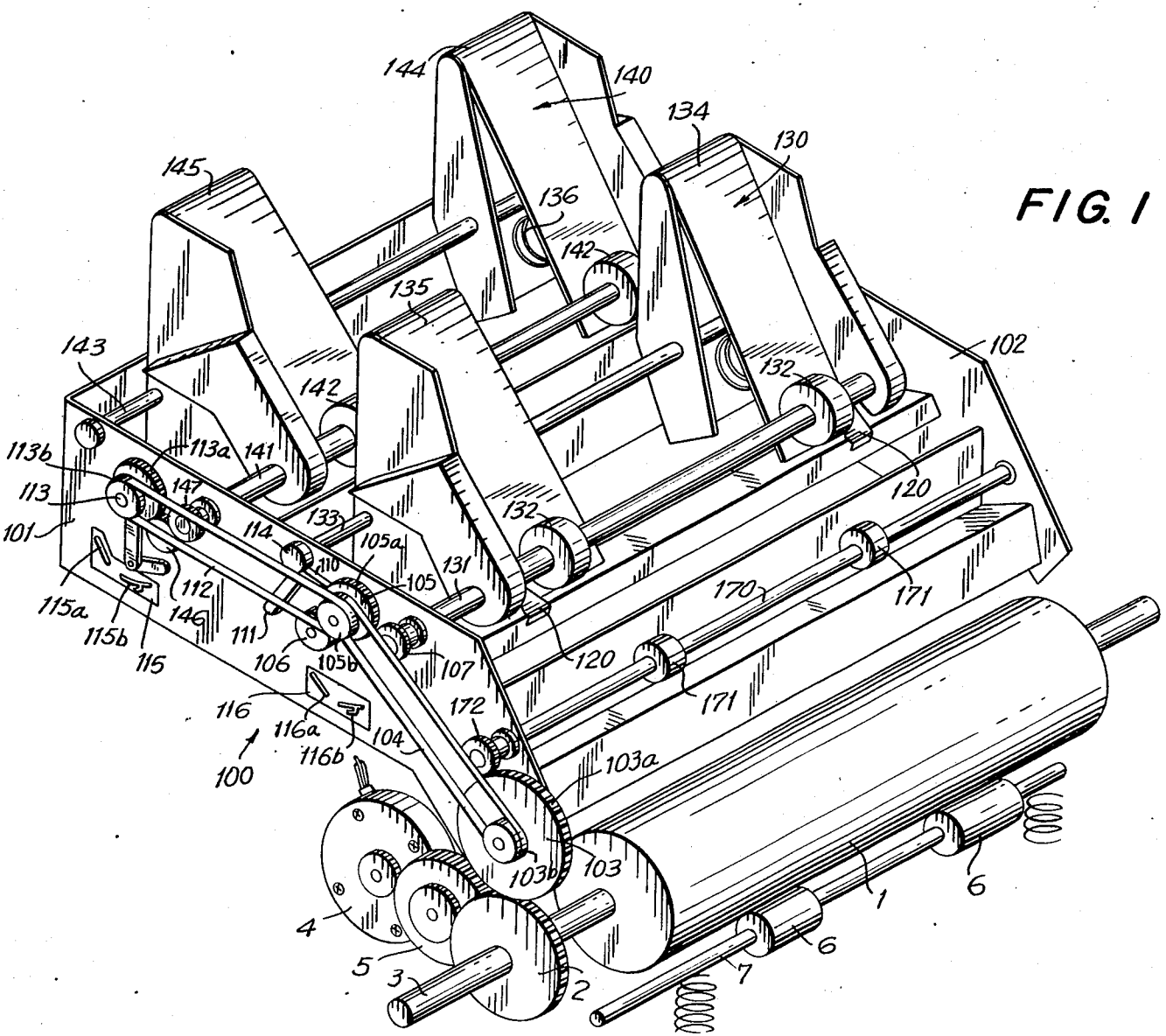
FIG. 1 is a perspective view of a paper feeding apparatus constructed in accordance with a preferred embodiment of the invention.
Figure 2A:
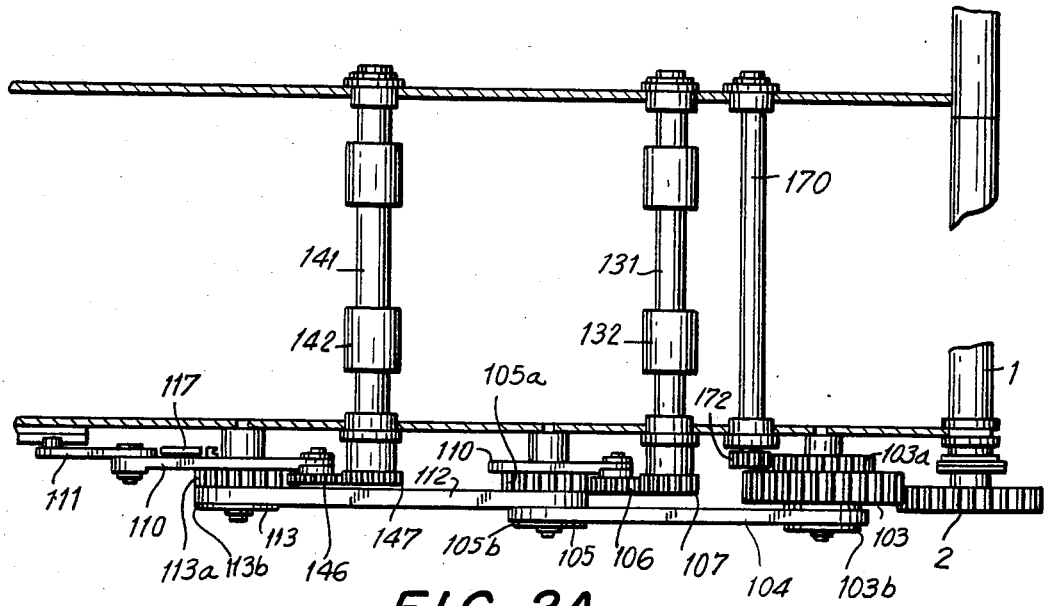
FIG. 2A is a top plan view of the gear train of the power transmission in the paper feeding apparatus constructed in accordance with the invention.
Figure 2B:
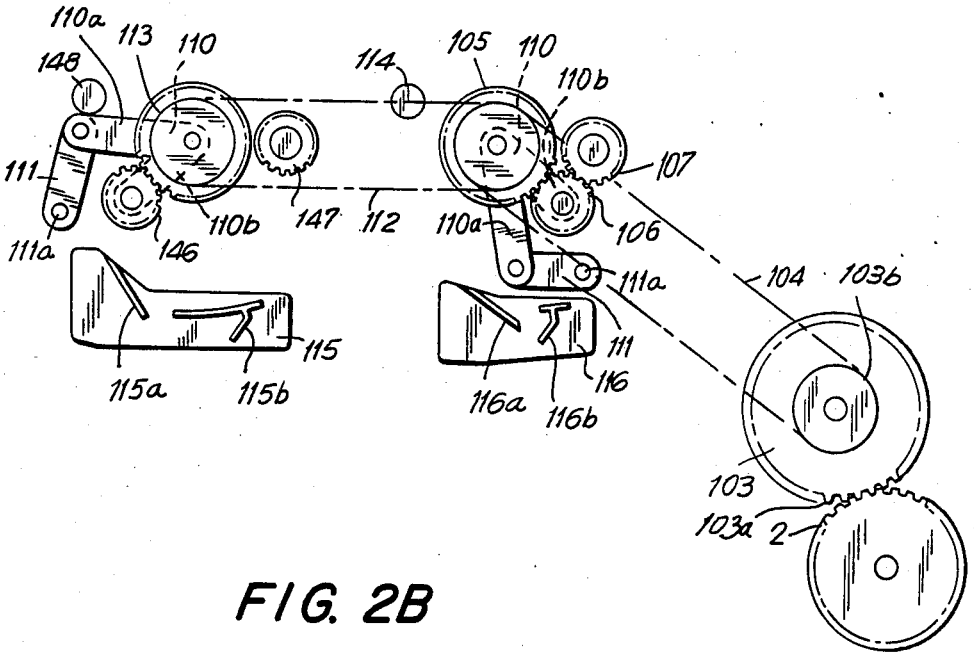
FIG. 2B is a side elevational view of the gear train of FIG. 2A.

Reference is made to FIGS. 1, 2A and 2B wherein a print feed apparatus generally indicated as 100 constructed in accordance with a preferred embodiment of the invention is depicted. Print feed apparatus 100 includes left and right side frames 101 and 102, respectively. Side frames 101 and 102 have various openings to receive shafts supported between frames 101 and 102. Side frames 101 and 102 are shaped so as to rest on top of a printer proximate to the platen 1 of the printer. Platen 1 is supported on a platen shaft 3 which also supports a platen gear 2 which co-rotates with shaft 3 and platen 1. Platen 1 is rotated by a paper feeding motor 4 which transmits clockwise and counterclockwise rotation as viewed in FIG. 1 to platen gear 2 through an intermediate gear 5. By clockwise and counterclockwise rotation of paper feeding motor 4, platen 1 can be rotated either forward or backward (clockwise or counterclockwise). In normal use of the printer, paper is advanced by forward (clockwise in FIG. 1), rotation of the platen which advances paper around the platen and between platen 1 and paper advancing rollers 6 on a spring supported shaft 7 in a conventional manner.

Paper feeding apparatus 100 includes a transmission gear pulley 103 rotatably coupled to side frame 101. Transmission gear pulley 103 has an outer gear **103*a* and an inner pulley 103*b*. When paper feeding apparatus 100 is placed in its operating position on top of the printer, transmission gear 103*a* engages with platen gear 2. In this way, any rotation of platen gear 2 is transmitted to transmission gear pulley 103. The motor power transmitted from platen gear 2 to transmission gear pulley 103 is then transmitted to a gear pulley 105, having a gear 105*a* and a pulley 105*b*, by a timing belt 104 wound around pulley 103*b* and pulley 105*b*. This transmitted power is then further conveyed from gear pulley 105 to a second gear pulley 113 via a timing belt 112 wound around pulleys 105*b* and 113*b*. In this way, both gear pulley 105 and gear pulley 113 are driven by platen gear 2 through gear pulley 103 and timing belts 104 and 112**.

Paper feeding apparatus 100 also includes two separate paper tray assemblics generally indicated as 130 and 140, respectively. Paper feeding assembly 130 includes a paper feeding roller shaft 131 with paper feeding rollers 132. Paper feeding roller shaft 131 extends from side wall 102 through side frame 101 terminating in a paper feeding roller gear 107. It also includes a shaft 133 extending from side wall 102 to side wall 101, extending through side wall 101 and terminating in a reset shaft 114. Two paper tray elements or guide elements 134, 135 are slidably supported on shafts 131 and 133. Elements 134 and 135 can be adjusted by sliding to an appropriate width for the paper and a plurality of sheets can be placed on elements 134 and 135. The paper feeding rollers 132 rest against the top sheet. The paper is maintained in contact with rollers 132 by a biasing member such as a spring 136. This allows for varying amounts of paper to be reliably held.

Paper holding member 140 likewise includes a shaft 141 with paper feeding rollers 142. Shaft 141 extends from side member 102 through side member 101 terminating in a paper feeding roller gear 147. Paper feeding member 140 also includes a second shaft 143 extending from side member 102 through side member 101 and terminating in a reset shaft 148. There are two paper tray elements 144, 145. Paper tray elements 144 and 145 are slidably mounted on shafts 141 and 143 to adjust the distance between them for varying widths of paper. A biasing member such as a spring 136' is utilized to maintain pressure by the top sheet of paper against paper feeding rollers 142.

Paper feeding roller gears 107 and 147 are close to pulley or sun gears **105*a* and 113*a*** but do not engage or mesh with them.

As best seen in FIG. 2B, a selector planet lever 110 is rotatably coupled to side wall 101 having a flucrum point of rotation at the center of sun gear 105. Selector planet lever 110 has a first arm **110*a* and a second arm 110*b* separated by an acute angle. A planet gear 106 is rotatably mounted at the end of arm 110*b*. Planet gear 106 is located so as to engage or mesh with sun gear 105*a*. As a result, rotation of gear 105*a*, due to movement of platen gear 2, causes the relative rotation of selector planet lever 110 about its fulcrum point. Arm 110*a* of selector planet lever 110 has a selector lever 111 attached proximate the end of arm 110*a*. Selector lever 111 is attached to selector planet lever 110 so that it rotates, and when no rotation is imparted to sun gear 105, selector lever 111 maintains a constant angle with selector planet lever 110. This is achieved by means of a selector lever spring 117 (FIGS. 2A and 3B**).

Selector lever 111 has a protrusion **111*a* at the end opposite the rotatable connection with arm 110*a*. Side wall 101 has fixed to it a camming member 116. Camming member 116 has separate camming surfaces 116*a* and 116*b*. In various orientations of selector lever 111, protrusion 111*a* contacts and is directed by camming surfaces 116*a* and 116*b*** as described below.

A second selector planet lever 110 with arms **110*a* and 110*b* is rotatably mounted with a fulcrum point at the center of sun gear 113, with a similar selector lever 111 coupled to the end of arm 110*a*. Likewise, a planet gear 146 is rotatably coupled to the end of arm 110*b* and meshes with sun gear 113. As a result, rotation of sun gear 113, due to rotation of platen gear 2, causes relative rotation of selector planet lever 110 about sun gear 113. A camming member 115 is coupled to the outside of side member 101 below sun gear 113. Camming member 115 has camming surfaces 115*a* and 115*b* designed to interrupt and direct the movement of selector lever 111 through contact with protrusion 111*a***.

Reference is next made to FIG. 2B. Platen gear 2 of the printer provides motive power through platen transmission gear pulley 103 to pulley or sun gear 105 by a timing belt 104 and the transmission power is further conveyed from gear 105 to a pulley or sun gear 113 by a timing belt 112 as described above. When planet gear 106, attached to arm **110*b* of selector planet lever 110, is rotated counterclockwise, it meshes with paper feeding roller shaft gear 107 as shown in FIG. 2B, and the transmitted power is conveyed to paper feeding rollers 132 via shaft 131. This has the effect of causing the top sheet of paper in paper compartment 130 to be advanced downward toward platen 1**.

This movement is further enabled by a shaft 170 extending from side panel 102 through side panel 101 and terminating in a gear 172 which engages with transmission gear 103. Shaft 170 has intermediate rollers 171 which rotate with shaft 170. As a result, the movement of the paper is assisted by rollers 171 which are rotated by the power generated from gear 103.

The protrusions 111*a* on selector levers 111 are shaped so as to engage with selector cam members 115 and 116. Only when selector levers 111 pass by selector cams 115 or 116 in the proper way, as a result of a combination of clockwise and counterclockwise rotation of paper feeding motor 4 of the printer, do planet gears 106 and 146 engage with paper feeding roller shaft gears 7 and 147, respectively. The selector cams 115 and 116 have differently shaped camming surfaces 115*a* and 115*b*, and 116*a*, and 116*b*, respectively, so that different combinations of clockwise and counterclockwise rotation of paper feeding motor 4 as (as viewed in FIG. 1) are required to allow the selector levers 111 to reach an engaging position. Accordingly, selection of one of the paper feeding rollers 132, 142 is possible by appropriate control of clockwise and counterclockwise rotation of paper feeding motor 4.

Figure 3A:
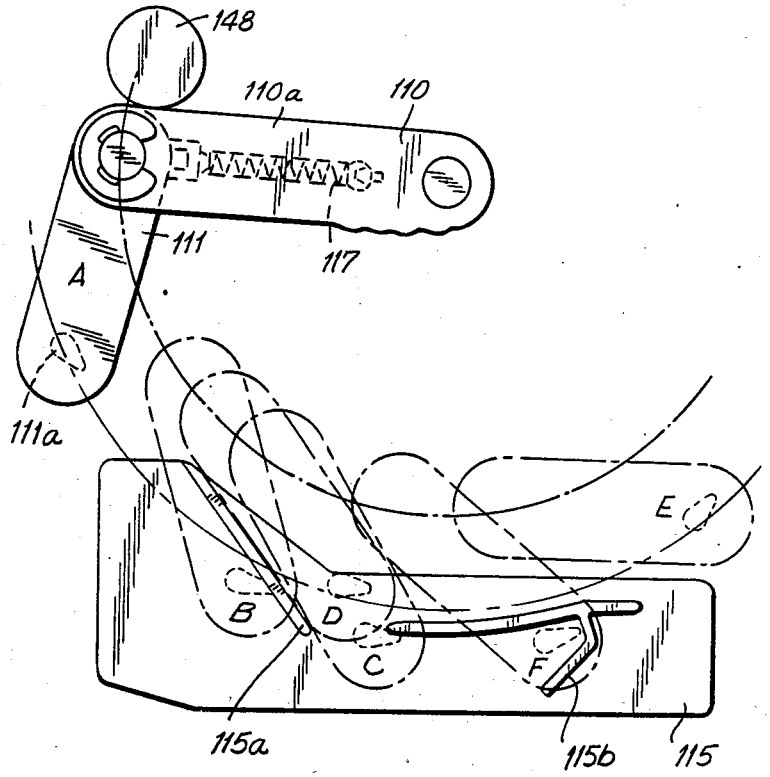
FIG. 3A is a side elevational view partially cut away, showing the operation of a portion of the power transmission of the paper feeding apparatus constructed in accordance with the invention in various positions.
Figure 3B:
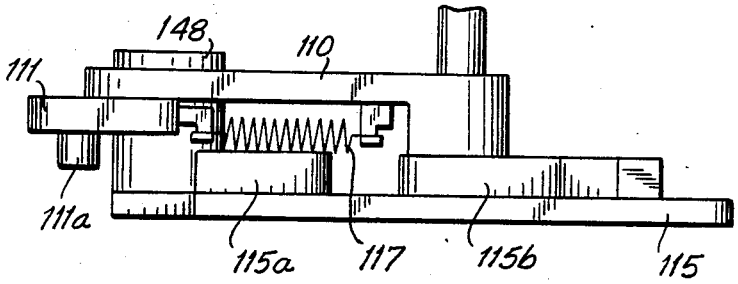
FIG. 3B is a side elevational view of the portion of the power transmission shown in FIG. 3A.

Reference is next made to FIG. 3A wherein the manner in which protrusion 111*a* and camming surfaces 115*a* and 115*a* interact is depicted. Selector planet lever 110 is shown in FIG. 3A with arm 110*b* having planet gear 146 removed for clarity of explanation. When platen 1 rotates in a counterclockwise direction (FIG. 1), selector planet lever 110 is rotated in a clockwise direction (FIGS. 1 and 3A), until it touches reset shaft 148 and then stops (shown in solid lines as position A). Since pulleys 105*b* and 113*b* are connected by timing belt 112, counterclockwise rotation of platen 1 by more than a predetermined amount places selector planet lever 110 in position A.

Position A is a known reset position in which all selector planet levers 110 and selector levers 111 are in the position shown in FIG. 3A. Reset shaft 148 (or reset shaft 114) prevent further clockwise rotation of 110. Then, when platen 1 rotates in a clockwise direction, protrusion 111*a* is forced along the bottom surface of camming surface 115*a*, as is shown in FIG. 3*a* as position B in dotted lines. To engage planet gear 146 and paper feeding roller gear 147, pivot arm must be rotated in the clockwise direction to the position shown as C. Then, platen 1 must be rotated counterclockwise by the appropriate amount so that selector lever 11 moves from position C to position D. At position D protrusion 111*a* disengages from camming member 115*b*, causing selector lever 111 to return to its neutral angled position with respect to arm 110*a*. Finally, when platen 1 is again rotated clockwise by the appropriate amount, selector lever 111 moves from position D to position E. Selector planet gear 146 engages with paper feeding roller gear 147 (as shown in FIG. 1) in position E, and the top sheet in tray element 140 is separated by separating pawls 120 and fed out of paper feeding apparatus 100.

When the leading edge of the sheet fed out of the paper feeding apparatus contacts the region between platen 1 and paper advancing roller 6 adjacent to platen 1, the leading edge of the sheet deflects during the continuing clockwise rotation of platen 1. When the proper deflection has been achieved, platen 1 is reversed and turned counterclockwise so that the sheet is wound around platen 1 between paper advancing roller 6. This feeds the paper into the printing mechanism in preparation for printing by a printing head (not shown) or other print mechanism.

Thus, after the paper is advanced against platen 1 and platen 1 is then rotated counterclockwise to draw the paper in, selector planet levers 110 rotate clockwise so that selector planet gears 106 and 146 disengage from paper feeding roller gears 107 or 147 (depending upon which paper tray has been selected), and paper feeding roller 132 or 142 can freely rotate as the paper is pulled down between platen 1 and paper advancing roller 19. By allowing the free rotation of rollers 132 and 142 when the printer is printing, the feeder ceases to affect the paper's movement. Finally, selector planet levers 110 return to the reset position shwon as position A in FIG. 3A. As a result, by repetition of this process a continuous stream of single sheets from a plurality of trays can be fed into the printer.

It is critical that only one of the paper feeding rollers (132 or 142) is enabled at a time to assure that only a single sheet of paper is transmitted to the printer. Thus, reference is made to FIG. 3A to show the movement of selector lever 111 when engagement of planet lever 146 and paper feeding roller gear 147 is not desired.

When selector lever 111 is located in position C, if platen 1 is rotated forward in a clockwise position, rather than reversing the rotation of the platen to a counterclockwise direction, selector lever 111 continues on to position F where protrusion 111*a* is locked within camming surface 115*b*. In position F selector planet gear 146 does not engage with paper feeding roller gear 147. During this time, the other selector lever 111 can be in a position comparable to position E causing engagement of planet gear 106 and paper feeding roller gear 107 to allow rotation of paper feeding shaft 131 and rollers 132.

Reference is next made to FIGS. 4A–4E wherein the manner in which paper feeding apparatus 100 selects and feeds a sheet of paper from paper tray assembly 130 (front cut sheet feeder).

Figure 4A:
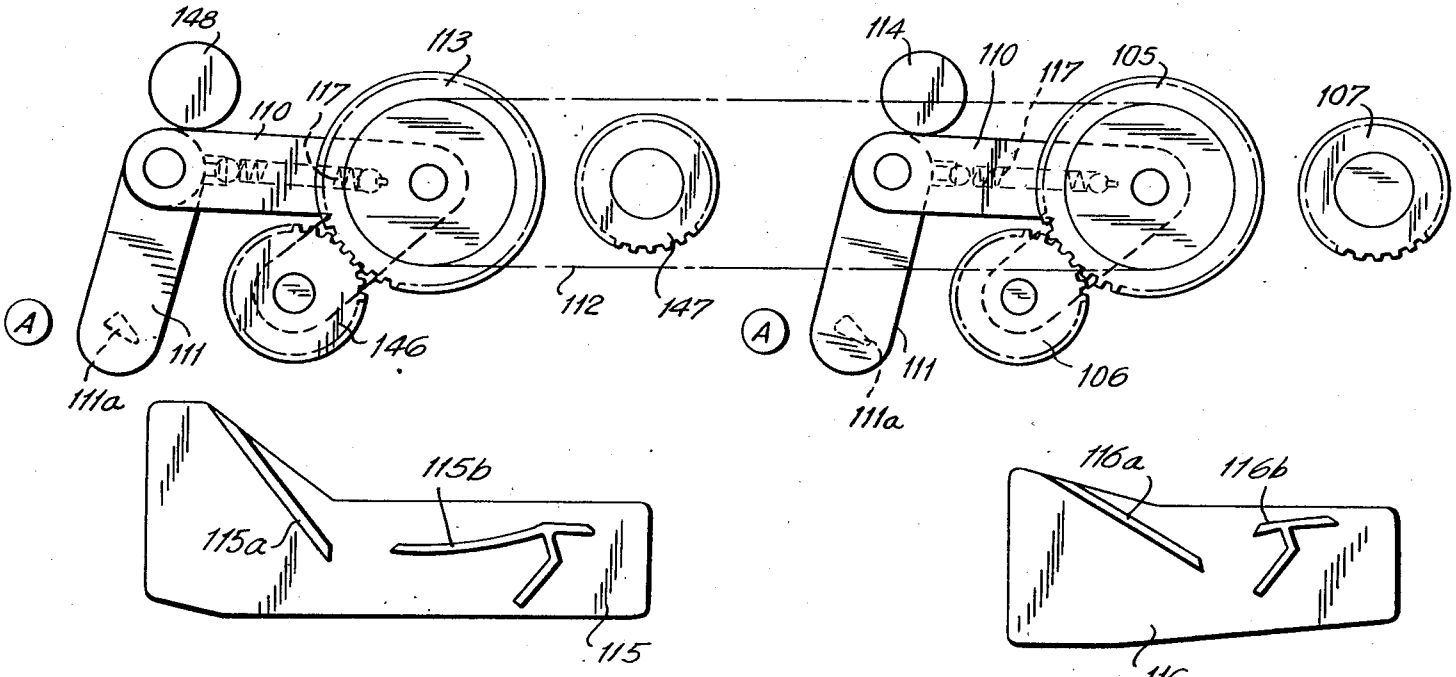
FIGS. 4A–E are side elevational views of the selection mechanism sequentially showing the manner of selecting the front paper feeding tray.

In response to rotational power generated by motor 4, platen gear 2 drives gear pulley 105 through timing belt 104 and gear pulley 105 in turn rotates gear pulley 113 through timing belt 112. Motor 4 rotates gear pulleys 105, 113 clockwise until selector planet levers 110 have rotated counterclockwise until they are stopped by engagement with reset shafts 114 and 148 as shown in FIG. 4A. As noted above, this is a reset position from which paper tray selection can be initiated based on the known starting point.

Figure 4B:
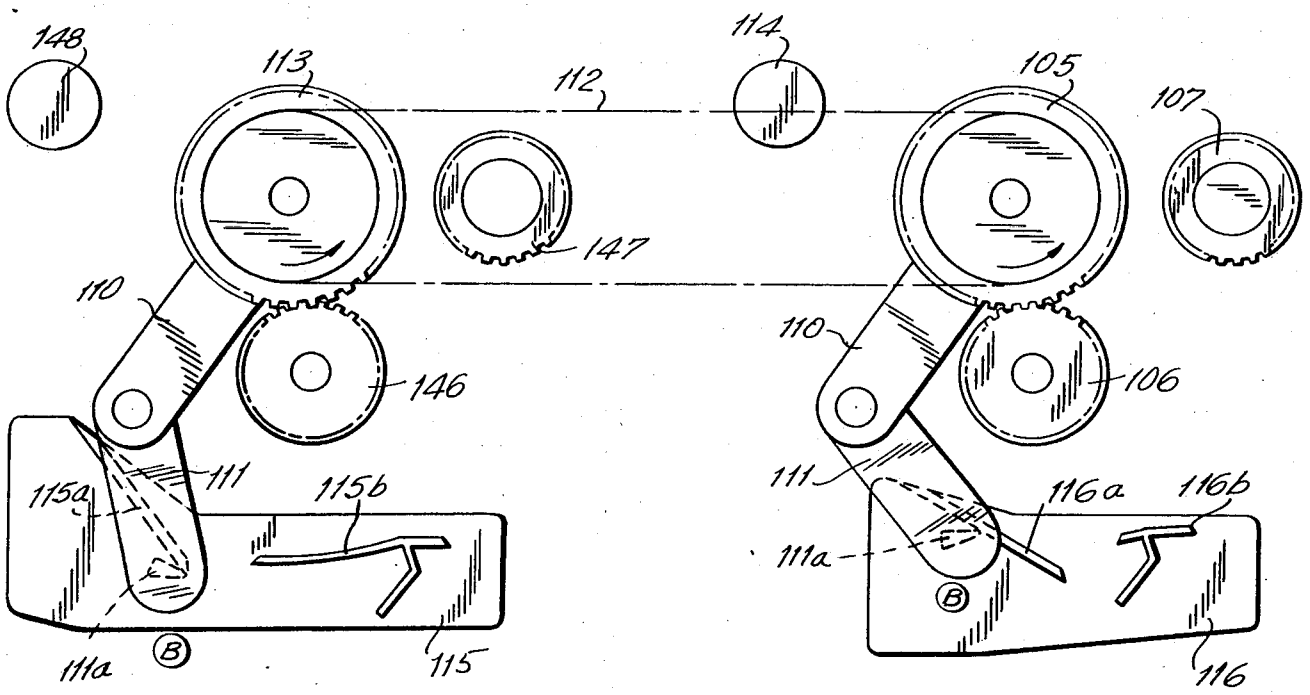

To select the front cut sheet feeder assembly 130, gear pulleys 105 and 113 are rotated clockwise (as shown by the arrows in FIG. 4B) which causes selector planet levers 110 to rotate counterclockwise. FIG. 4B shows selector levers 111 rotated counterclockwise to a position Ⓑ, with protrusions 111*a* in contact with the left side of camming surfaces 115*a* and 116*a* of selector cams 115 and 116, respectively.

Figure 4C:
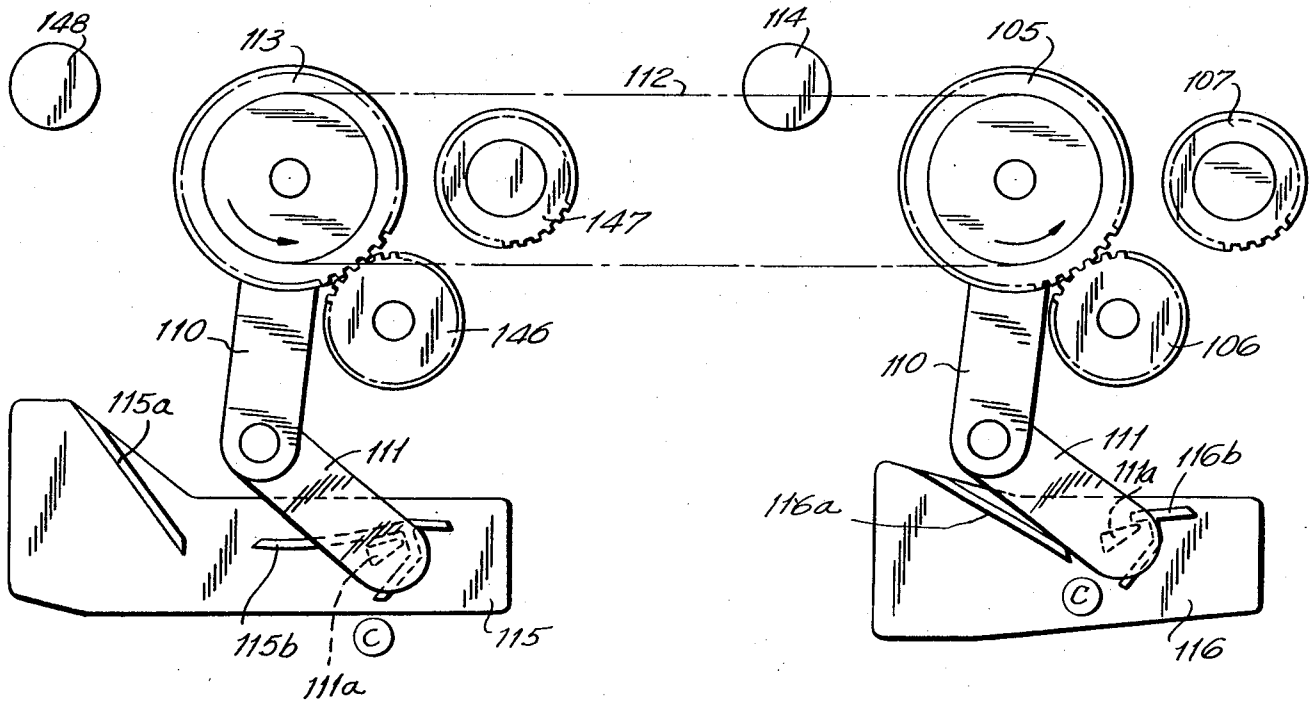

Next, as shown in FIG. 4C, gear pulleys 105 and 113 continue to rotate counterclockwise, as shown by the arrows in gear pulleys 105 and 113, to positions Ⓒ. In position Ⓒ, protrusion 116*a* of the selector mechanism for the front cut sheet feeder 130 has slid into contact with camming surface 116*b* of selector cam 116. On the other hand, protrusion 111*a* for the back cut sheet feeder 140 slides entirely into camming surface 115*b*.

Figure 4D:
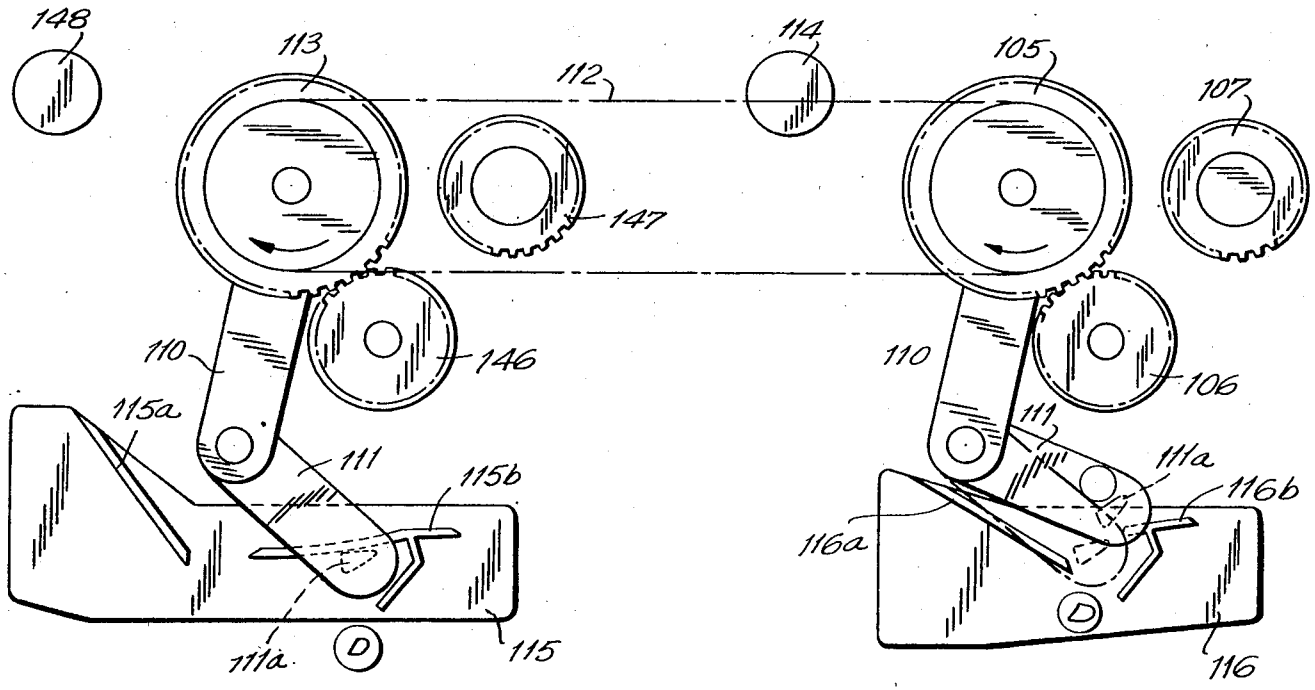
Figure 4E:
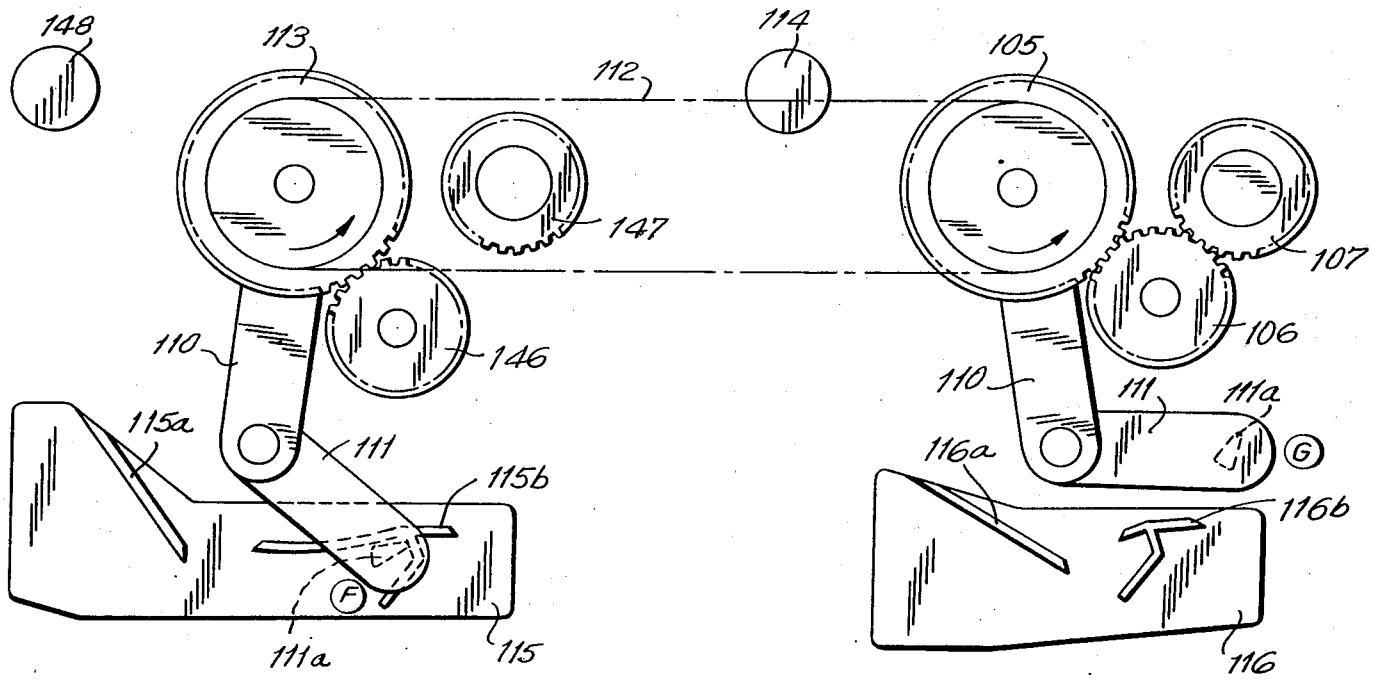

Next, when the rotational direction of gear pulleys 105, 113 are reversed to a clockwise direction selector levers 110 move to position Ⓓ (FIG. 4D). In position Ⓓ the protrusion 111*a* for cut sheet feeder 140 is still prevented from moving by camming surface 115*b*.

However, protrusion 111*a* for the front cut sheet feeder 130 is free of camming surfaces 116*a*, 116*b* and freely moves upward to position Ⓔ under the power of selector lever spring 117. In each of positions Ⓐ - Ⓔ of both protrusions 111*a* there is no engagement of gears 107 and 106 or gears 147 and 146.

Finally, gear pulleys 105 and 113 are again rotated in a counterclockwise direction. Projection 111*a* of the rear cut sheet feeder 140 again locks within camming surface 115*b*, maintaining gears 146 and 147 out of engagement so that no power is transmitted to shaft 141. On the other hand, projection 111*a* of the front cut sheet feeder 130 advances to a position G which causes the engagement of selector planet gear 106 and paper feeding roller gear 107 so that a sheet of paper on the front cut sheet feeder 130 is advanced to platen 1 by paper feeding rollers 132.

In this way paper is fed out of cut sheet feeder 130 while assuring that no paper is fed out of cut sheet feeder 140.

Figure 5A:
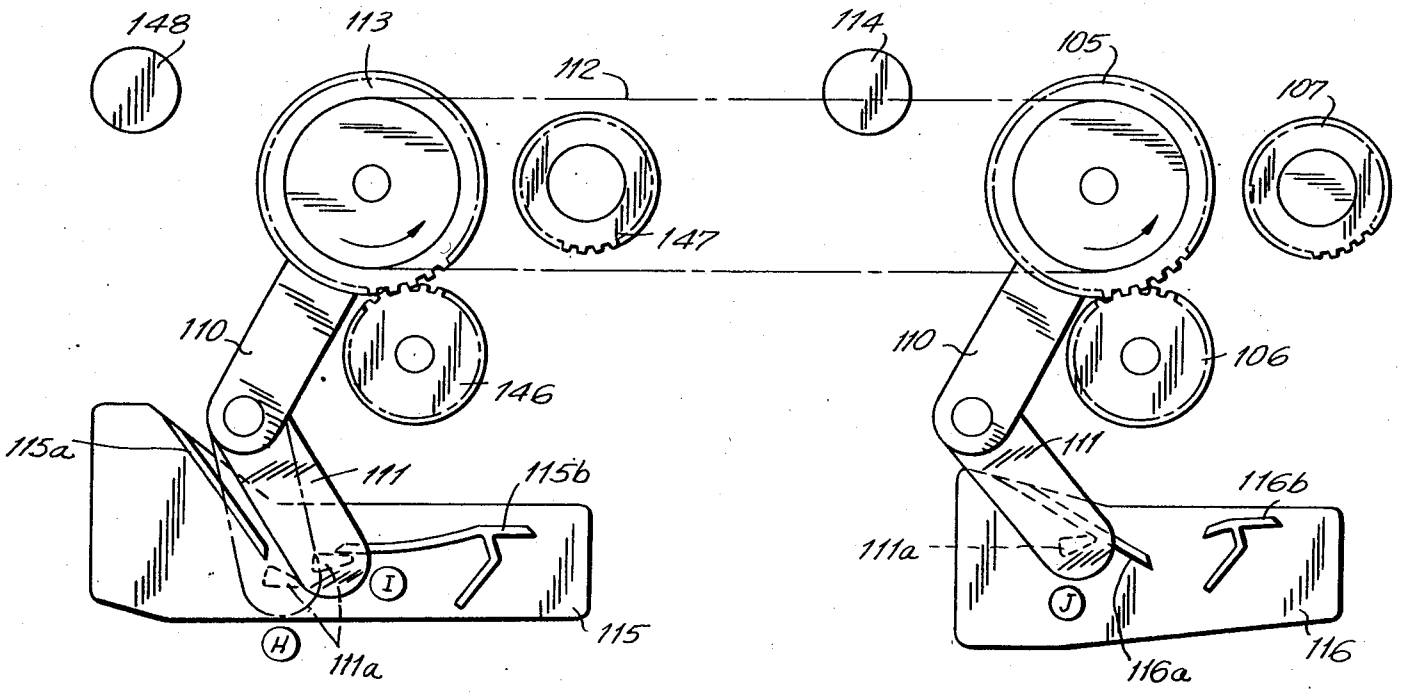
FIGS. 5A–C are side elevational views of the selection mechanism shown in FIGS. 4A–4E showing the sequential selection of the back paper feeding tray for paper feeding.
Figure 5B:
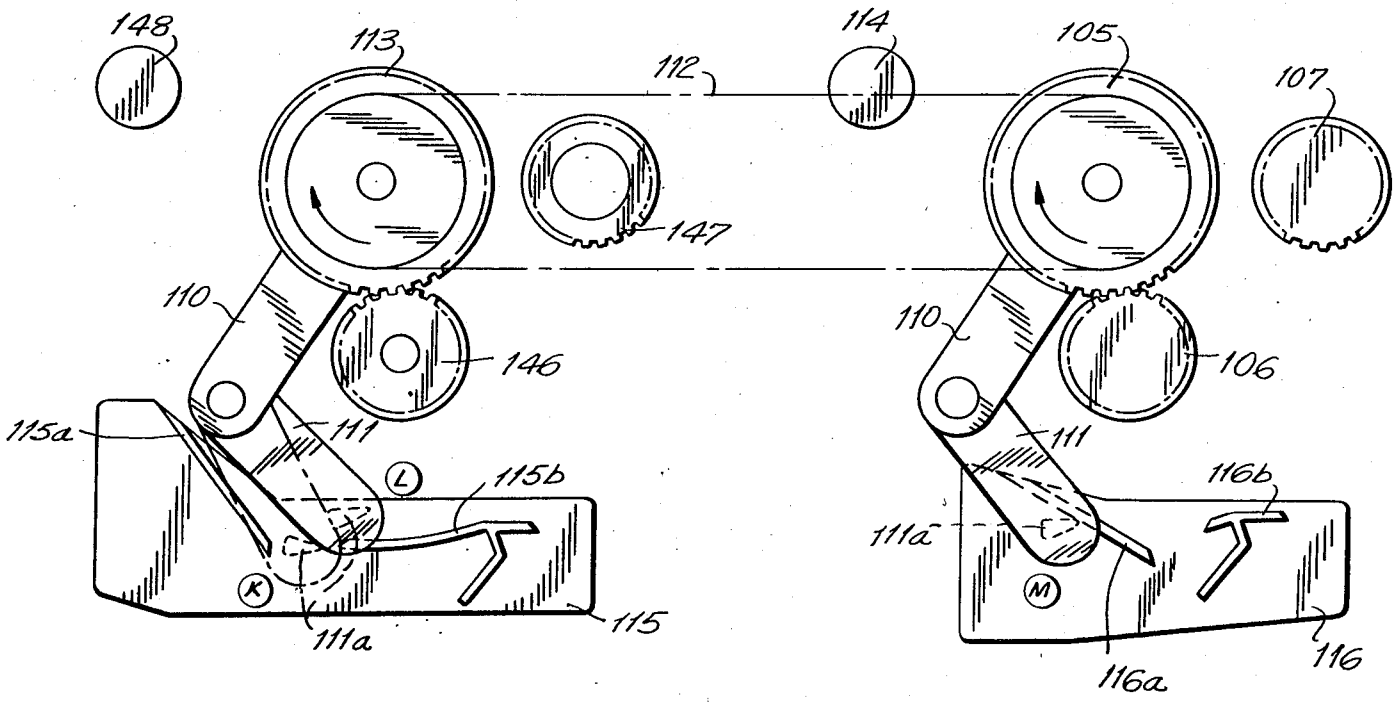
Figure 5C:
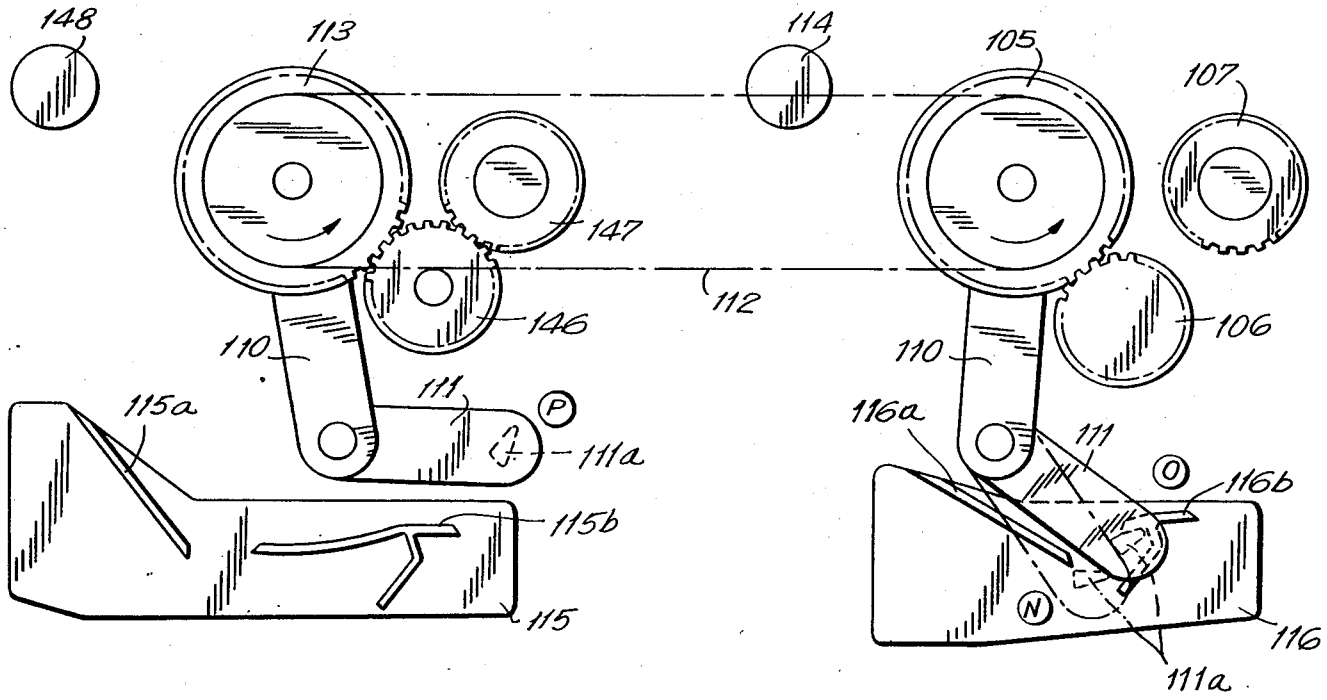

Reference is next made to FIGS. 5A, 5B and 5C wherein the manner in which paper feeding apparatus 100 selects and feeds a sheet of paper from paper tray assembly 140 (back cut sheet feeder).

The starting position for feeding a sheet of paper from the back cut sheet feeder 140 is the same as for feeding a sheet of paper from the front cut sheet feeder 130. This position is shown in FIG. 4A.

Selector levers 111 are rotated in the same way as described above with respect to FIGS. 4A–4E in a clockwise manner so that projections 111*a* above the front and back cut sheet feeders 130, 140 move to position Ⓙ and Ⓗ, respectively. Selector level 111 rotates from position Ⓗ to position Ⓘ as a result of protrusion 111*a* being free of camming surface 115*a*. The rotation is caused by selector lever spring 117 and terminates when protrusion 111*a* contact camming surface 115*b*.

As shown in FIG. 5B, gear pulleys 105 and 113 are rotated in a clockwise manner to move selector levels 111 and protrusions 111*a* from positions Ⓘ and Ⓙ to positions Ⓚ and Ⓜ, respectively. Selector lever 111*a* of the back cut sheet feeder 140 rotates from position Ⓚ to position Ⓛ due to the force exerted by selector lever spring 117 as a result of protrusion 111*a* being out of engagment with both of camming surfaces 115*a* and 115*b*. Selector planet gears 146, 106 and paper feeding rollers 147 are not engaged. Accordingly, no paper is fed from the cut sheet feeder up to this point.

As gear pulleys 105 and 113 are again rotated in a counterclockwise direction as shown in FIG. 5C, projection 111*a* rotates freely in a counterclockwise manner to position Ⓟ causing selector planet gear 146 to mesh with paper feeding roller 147. As a result, the back cut sheet feeder 140 is driven causing paper feeding roller 132 to advance a single sheet of paper to platen 1. Selector level 111 and projection 111*a* associated with the front cut sheet feeder 130 moves from position Ⓝ to position Ⓞ under the force of selector lever spring 117. As a result, selector planet gear 106 and paper feeding roller 107 are maintained out of engagement so that no paper is fed from the front cut sheet feeder when the back cut sheet feeder 140 is selected.

In this way it is possible to select one of plurality of paper feeding shafts and to rotate the shafts in accordance with the shapes of the appropriate camming members. By combining appropriate counterclockwise and clockwise rotation of the platen, which corresponds to counterclockwise and clockwise rotation of the printer's paper feeding motor, selection of paper from various trays is allowed. This control can be implemented by software for driving the printer.

The paper feeding apparatus is shown as two separate tray areas for holding paper. By extension of the principles shown, a paper feeding apparatus with three or more separate trays for feeding paper can be utilized. It is only necessary for different camming members with differently shaped camming surfaces to provide the ability to select one of a number of different paper feeding trays controlled solely by the clockwise and counterclockwise rotation of the platen. In this way, the paper can be selected by a software driven approach which controls the movement of the platen.

Other mechanical structures are available in accordance with the invention including the use of a gear instead of a timing belt for power transmission.

Accordingly, a paper feeding apparatus in which a cut sheet is selected from among a plurality of paper trays by use of selector cams, selector levers and planet gears is provided. In accordance with the above structure it is possible to provide a paper feeding apparatus having a plurality of paper trays which are separately addressable by software for driving the printer motor. Furthermore, this paper feeding apparatus produces these benefits at low cost without the need for high priced parts such as a one-way clutch.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A paper feeding apparatus for a printer having a paper feed motor, comprising:

at least two mounting means each of which is adapted to contain sheets of paper;

paper feeding means associated with each of the mounting means and contacting the paper in the mounting means for feeding single sheets of paper from the mounting means;

paper feed gear means operatively coupled to each of the paper feeding means for co-rotation therewith;

sun gear means proximate each of the paper feeding gear means, each being rotatable about a center point;

transmission means for transmitting rotational power in first and second directions, said directions being opposite to one another, from the paper feed motor in the printer to each of the sun gear means;

selector means associated with each of the paper feeding means having a planet gear on a first arm and a protrusion on a second arm, the selector means being rotatable about the center point of the corresponding sun gear means, said planet gear engaging with said corresponding sun gear means; and selective camming means associated with each of the paper feeding means for controlling the rotation of the corresponding selector means by interaction with the protrusion on corresponding selector means to cause the selective engagement of the corresponding planet gear and paper feed means so that rotational power from the paper feed motor is transmitted to the paper feeding means when said paper feed motor rotates in the proper combination of said first and second directions;

whereby a single sheet of paper is fed to the printer from a selected mounting means which is determined by the sequence of rotations of the paper feed motor in the first and second directions.

2. The paper feeding apparatus of claim 1 wherein the selector means includes a V-shaped body portion having first and second arms, the second arm having a fixed member and a rotatable member mounted to the fixed member.

3. The paper feeding apparatus of claim 2 wherein the protrusion is located on the rotatable member.

4. The paper feeding apparatus of claim 3 wherein the selection means includes a biasing member rotatably coupling the rotatable member to the fixed member.

5. The paper feeding apparatus of claim 1 wherein the selector means is located behind the corresponding sun gear means.

6. The paper feeding apparatus of claim 1 wherein each said selective camming means includes at least two camming surfaces.

7. The paper feeding apparatus of claim 6 wherein the camming surfaces are adapted to engage and deflect the protrusion on the second arm of the corresponding selector means.

8. The paper feeding apparatus of claim 7 wherein a combination of movement of the paper feed motor in the first direction for a first predetermined angle followed by rotation in the second direction for a second predetermined angle, followed by rotation in the first direction through a third predetermined angle is required to cause the engagement of a planet gear and its corresponding paper feed gear means.

9. The paper feeding apparatus of claim 8 wherein the magnitudes of the first, second and third predetermined angles are varied between the selector means, thereby enabling selection of an appropriate paper feeding means by control of the first, second and third predetermined angles.

10. The paper feeding apparatus of claim 1 further comprising biasing means coupled to the mounting means for maintaining pressure against the rollers by the top sheet of paper.

11. The paper feeding apparatus of claim 10 wherein the biasing means includes a spring coupled to the mounting means for biasing the paper towards the roller.

12. The paper feeding apparatus of claim 1 wherein the selective camming means associated with each of the paper feeding means not selected for engagement of the corresponding planet gear and paper feed gear means, prevents such engagement.

13. The paper feeding apparatus of claim 1 wherein the transmission means includes transmission gear means operatively coupled to the paper feed motor and coupling means for transmitting the rotation from the transmission gear means to each of the sun gear means.

14. The paper feeding apparatus of claim 13 wherein the coupling means includes timing belts coupling the sun gear means and the transmission gear means.

15. The paper feeding apparatus of claim 14 wherein the sun gear means includes pulley surfaces for receiving the timing belts and the transmission gear means includes a gear surface and a pulley surface, the pulley surface being adapted to receive a timing belt.

16. The paper feeding apparatus of claim 15 wherein the gear surface of the transmission gear means is coupled to the printer paper feed motor through a platen gear, engaging with an intermediate gear, which engages with a gear on the paper feed motor.

17. The paper feeding apparatus of claim 7 further comprising reset means associated with each of the paper feeding means, positioned to interrupt the rotation of each of the selector means at a reset position.

18. The paper feeding apparatus of claim 1 wherein each of the paper feeding means include a paper feeding shaft with at least one roller thereon which co-rotates with the shaft and contacts the top sheet of paper in the corresponding mounting means.

19. The paper feeding apparatus of claim 18 wherein the paper feed gear means comprises a gear fixed to one end of the paper feeding shaft.

20. The paper feeding apparatus of claim 1 wherein there are two mounting means adapted to hold two different sizes of paper.

21. The paper feeding apparatus of claim 1 wherein each of the mounting means includes two guide members for holding a plurality of sheets of paper.

22. The paper feeding apparatus of claim 21 wherein the guide members are slidably movable to adjust the width of paper containable therebetween.

23. The paper feeding apparatus of claim 1 further comprising additional assisting means for moving a selected sheet of paper toward the platen.

24. The paper feeding apparatus of claim 23 wherein the additional assisting means includes a shaft with rollers operatively coupled to rotate with the paper feed motor.

* * * * *